US006269969B1

(12) United States Patent
Huang et al.

(10) Patent No.: US 6,269,969 B1
(45) Date of Patent: Aug. 7, 2001

(54) WET WIPES CONTAINER WITH IMPROVED CLOSURE

(75) Inventors: Yung Hsiang Huang, Appleton; Rodney Carlton Christianson, Oshkosh; Douglas Bryan Cole, Hortonville; Tammy Jo Balzar, Oshkosh; Stephen Bernard Studee, Middleton, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/565,793

(22) Filed: May 5, 2000

(51) Int. Cl.[7] ..... B65D 43/16; B65D 45/16
(52) U.S. Cl. ..... 220/835; 220/324; 206/1.5
(58) Field of Search ..... 220/254, 259, 220/833–835, 324, 326; 215/237; 206/233, 494, 1.5; 221/63

(56) References Cited

U.S. PATENT DOCUMENTS

| | | |
|---|---|---|
| D. 182,255 | 3/1958 | Smith . |
| D. 289,262 | 4/1987 | Goetz et al. . |
| D. 311,334 | 10/1990 | Flynn et al. . |
| D. 315,870 | 4/1991 | Perdue, Jr. et al. . |
| D. 330,161 | 10/1992 | Schuh . |
| D. 342,609 | 12/1993 | Brightbill . |
| D. 363,669 | 10/1995 | Pennoyer et al. . |
| D. 364,563 | 11/1995 | Miller et al. . |
| D. 367,609 | 3/1996 | Frank et al. . |
| D. 371,962 | 7/1996 | Petruzzi . |
| D. 374,774 | 10/1996 | Cassel . |
| D. 381,512 | 7/1997 | Green . |
| D. 384,502 | 10/1997 | Seager et al. . |
| D. 395,952 | 7/1998 | Buczwinski et al. . |
| 2,735,542 | 2/1956 | Schnitzler . |
| 2,842,178 | 7/1958 | Solomon . |
| 3,383,009 | 5/1968 | Weikert . |
| 3,737,067 | 6/1973 | Palson . |
| 3,747,802 | 7/1973 | Uroshevich . |

(List continued on next page.)

FOREIGN PATENT DOCUMENTS

| | | |
|---|---|---|
| 2 306 359 | 10/1976 | (FR) . |
| 2 675 778 | 10/1992 | (FR) . |
| WO 98/02362 | 1/1998 | (WO) . |

OTHER PUBLICATIONS

Translation of Japanese Patent Application No. H 5–338660.

*Primary Examiner*—Nathan J. Newhouse
(74) *Attorney, Agent, or Firm*—Alyssa A. Dudkowski

(57) ABSTRACT

A wet wipe container having improved opening and improved tear resistance between the lid and the base among other features. The container includes a container base and a container lid that is connected to the container base. In one embodiment, the container lid has a guide ridge that extends downward into the interior of the container. The guide ridge permits the container lid to be in a partially open position and provides better alignment between the container lid and the container base during closing of the container. In another embodiment, the container includes a closure that has an upwardly extending tongue projection, a flattened grip area and an assistive region to increase the ease with which the container can be opened. The invention also relates to a container having a more tear resistant container lid. The container lid has a hinge channel of a primary thickness. The hinge channel has two end regions that are of a secondary thickness that is greater than the primary thickness. The increased thickness of the end regions resists the tearing that can occur in the lid after repeated opening and closing of the container.

9 Claims, 10 Drawing Sheets

U.S. PATENT DOCUMENTS

| | | |
|---|---|---|
| 4,079,880 | 3/1978 | Edwards . |
| 4,100,324 | 7/1978 | Anderson et al. . |
| 4,377,245 | 3/1983 | Patty . |
| 4,522,312 | 6/1985 | Rathgeber et al. . |
| 4,671,408 | 6/1987 | Raines et al. . |
| 4,684,024 | 8/1987 | Ebrahim et al. . |
| 4,730,731 | 3/1988 | Allison . |
| 4,746,008 | 5/1988 | Heverly et al. . |
| 4,787,526 | 11/1988 | Pehr . |
| 4,890,742 | 1/1990 | Allison . |
| 4,925,041 | 5/1990 | Pehr . |
| 4,938,513 | 7/1990 | Gunderson . |
| 4,971,220 | 11/1990 | Kaufman et al. . |
| 4,971,372 | 11/1990 | Gunderson . |
| 4,986,438 | 1/1991 | Borst . |
| 4,989,747 | 2/1991 | Demurger . |
| 5,033,778 | 7/1991 | Niles et al. . |
| 5,040,680 | 8/1991 | Wilson et al. . |
| 5,050,737 | 9/1991 | Joslyn et al. . |
| 5,050,762 | 9/1991 | Giorgi . |
| 5,100,015 | 3/1992 | Vanderstuyf . |
| 5,322,178 | 6/1994 | Foos . |
| 5,356,017 * | 10/1994 | Rohr et al. . |
| 5,718,350 | 2/1998 | Williams . |
| 5,785,179 | 7/1998 | Buczwinski et al. . |

* cited by examiner

WET WIPES CONTAINER WITH IMPROVED CLOSURE

FIELD OF THE INVENTION

The present invention relates to a container for premoistened wipes. The invention particularly concerns container lids and container bases that secure to each other more easily. The engagement between the container lid and the container base is facilitated by structural guides that better position the lid on top of the base and by an improved closure. The invention also concerns an improvement in the tear resistance of the container lid and an improvement in the compression strength of the container.

DESCRIPTION OF THE RELATED ART

Wet wipes are well known commercial consumer products which have been available in many forms. Perhaps the most common form of wet wipes has been a stack of moistened sheets which have been packaged in a plastic container. The wet wipes have been made from a variety of materials which have been moistened with a variety of suitable wiping solutions. Typically, the wet wipes have been stacked in the container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Some of the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which is wound into a roll. Such wet wipes have been used for baby wipes, hand wipes, household cleaning wipes, industrial wipes and the like.

The conventional packages which contain wet wipes, such as those described above, have typically been designed to be positioned on a flat surface such as a countertop. Such conventional packages have generally provided a plastic container or tub which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant However, the opening of such conventional containers for wet wipes has not been completely satisfactory. For example, many conventional containers are not capable of being opened by a single hand or, if designed for opening by a single hand, are not easy to open with a single hand for all users. In such containers, the user typically has to open the package with both hands before dispensing a wet wipe. Many of such containers have been hard to open because they have included a cover which provides a positive frictional seal with the container body when closed to ensure that the wet wipes do not become overly dry. In addition, many conventional containers have included relatively small opening mechanisms which are difficult to manipulate with a single hand.

Another difficulty associated with conventional containers for wet wipes is that the lids of the containers typically must either be completely open or completely closed. Depending on the weight of the wet wipes remaining in the container, the container may tip backwards from the weight of an open lid. Therefore, conventional containers do not provide for a partially open position between the lid and the base of the container. Consequently, as the supply of wet wipes in the container is depleted, it becomes more difficult to obtain a wipe from the container using a single hand. In some conventional containers, there is poor alignment between the container lid and the container base. The poor alignment hinders the user's ability to secure the lid to the base, particularly when the operation must be done with a single hand.

With some wet wipe uses, such as with wet wipes for diaper changes, the container holding the wipes is opened and closed with great frequency. Frequent opening and closing of the container lid causes wear and stress on the connection or attachment between the lid and the base. After a number of opening and closing cycles, the connection can begin to fail and, in some cases, will result in the container lid tearing away from the container base. The rough surface produced by a torn lid can catch on skin or on fabric, thus becoming a nuisance. In the past, the exterior contours of some conventional containers have had right angles with rough edges that can catch on skin or fabric. For example, right angles often exist at the connection point between container lids and container bases.

During shipping and storage of the containers, the containers are often stacked vertically on top of each other. The stacking can be done on a pallet or within a shipping/storage container. The vertical stacking of the containers on top of each other results in a substantial force acting on the top of the container. If the container does not have sufficient compressive strength, the lid or base can become deformed by outward bowing or buckling. Some conventional containers have not been designed to withstand the magnitude of force experienced during routine shipping and storage.

SUMMARY OF THE INVENTION

In response to the difficulties and problems discussed above, a new container for wet wipes that has improved opening and dispensing, is capable of maintaining a partially open position, has improved alignment between lid and base, has improved tear resistance and has improved compression strength has been discovered. The purposes and advantages of the present invention will be set forth in and apparent from the description that follows, as well as will be learned by practice of the invention. Additional advantages of the invention will be realized and attained by the containers particularly pointed out in the written description and claims hereof, as well as from the appended drawings.

In one aspect, the present invention relates to a wet wipe container that includes a container base and a container lid. The container lid is connected to the container base. The container lid and the container base can be a single component or can be separate components. The connection between the container lid and the container base can be in the form of an ultrasonic bond, an interlocking hinge or other form of connection known in the art. The container lid has a top and a front wall, a rear wall and a pair of opposed side walls. The walls extend downwardly from the top of the container lid in a generally rectangular configuration. The walls can also extend downward in a generally trapezoidal configuration. The container base has a bottom and a front wall, a rear wall, and a pair of opposed side walls. The walls extend upwardly from the bottom of the container base in a generally rectangular configuration to provide an interior for containing the wet wipes. The walls can also extend upward in a generally trapezoidal configuration.

The top of the container lid has a downwardly extending guide ridge. The rear wall of the container lid defines a length that is approximately the same as the overall length of the container. The guide ridge is generally parallel to the rear wall of the container lid and the guide ridge is located close to or proximate the rear wall. The guide ridge has a length that is less than the length of the rear wall. For example, the ratio of the length of the guide ridge to the length of the rear wall, which generally represents the length of the container, can be desirably, but not exclusively, from about 40% to about 90%. Further, the guide ridge can extend downward a distance of from about 0.25 inches to about 0.75 inches. The guide ridge can also have a thickness that is from about 0.0625 inches to about 0.25 inches. The rear wall of the container base has an upper portion that defines a receiving edge. The receiving edge is generally configured to receive the guide ridge of the container lid. For example, the receiving edge can be arc-shaped. The receiving edge gradually receives the guide ridge as the container lid is rotated from an open position to a closed position. Among other things, the guide ridge facilitates single hand opening and closing of the container. Further, the guide ridge improves the alignment between the container lid and the container base. The guide ridge also permits a partially open position of the container lid. The container is stable and does not tip over when the container lid is partially open, even if there are only a few wet wipes remaining in the container. In the partially open position, the container lid is from about 1.5 inches to 3.0 inches above the container base. The partially open position allows a person to reach into the container to pick up a wet wipe with only one hand.

The container lid can be fabricated from a polymer, copolymer or mixtures of both. For example, the container lid can be made primarily of a copolymer of styrene-butadiene-styrene. The container lid can be transparent or translucent to, in part, facilitate determination of the quantity of wipes remaining in the container. The container base can likewise be fabricated from a polymer, copolymer or mixtures of both. For example, the container base can be primarily made of polystyrene. The container base can be made of either an opaque, translucent or transparent material. Dyes, tints and colorants can be added to the material of either the container lid or the container base. The wet wipe containers of the invention can be beneficially used for secondary purposes when they are no longer used to contain wet wipes. For example, the containers can be used to store small toys, art supplies and other household items. When the container lid and container base are translucent or transparent, it is possible to see what is inside of the container without opening the lid.

The corners that are formed at the intersections of the various walls of the container lid and the container base can be rounded. More particularly, the corners between the front walls, the rear walls, the side walls, the top and the bottom can be curvilinear. The container lid and the container base can be joined together at their respective rear walls. The container lid and the container base can be joined or connected by the variety of ways known in the art including by ultrasonic bonds.

In another aspect, the present invention relates to a wet wipe container including a container base and a separate container lid that is attached to the container base. The container lid can be attached to the container base in a variety of ways including by a hinge arrangement, by pins, by interlocking edges, by ultrasonic bonding and other ways of attachment known in the art. The container lid has a top and a front wall, rear wall and a pair of opposed side walls. The walls extend downwardly from the top in a generally rectangular configuration.

The rear wall of the container lid includes an outwardly extending flange. The outwardly extending flange can be primarily two-dimensional and, therefore, the flange has a width and a length. The flange can be thought of as being divided into three areas: the area immediately adjacent the rear wall of the container lid, a hinge channel and an attachment area. The attachment area is located most distally to the rear wall of the container lid and the hinge channel is located between the immediately adjacent area and the attachment area. The three areas are primarily linear and they are configured to be generally parallel to each other and to the rear wall of the container lid. Each of the areas has an independent length that is no greater than the length of the rear wall of the container lid. Starting from the area near the rear wall, the length of the flange can gradually taper along the width of the flange. In this case, the length of the flange near the rear wall would be greater than the length of the flange at the attachment area. The length of the hinge channel would be between the lengths of the area near the rear wall and of the attachment area. For example, the ratio of the length of the flange at the hinge channel to the total length of the container lid can be from about 60% to about 85% and the ratio of the length of the flange at the attachment area to the total length of the container lid can be from about 50% to about 75%.

The hinge channel has two end regions, each end region being located at an end of the hinge channel. The hinge channel has a primary thickness and the end regions of the hinge channel have a secondary thickness that is greater than the primary thickness. The primary thickness of the hinge channel can be from about 0.005 inches to about 0.015 inches. The secondary thickness of the end regions can desirably be from about 20% to about 100% greater than the primary thickness.

In addition to the thickness of the hinge channel, there is an overall thickness to the outwardly extending flange. The thickness of the flange can vary over the width of the flange. For example, the flange thickness includes the thickness near the rear wall, the secondary thickness of the end region of the hinge channel and the thickness of the attachment area. If the thickness of the flange near the rear wall of the container lid and of the attachment area are greater than the secondary thickness, the thickness of the flange can gradually decrease along the width until the thickness matches the secondary thickness. Conversely, if the thickness of the flange near the rear wall and of the attachment area are less than the secondary thickness, the thickness of the flange can gradually increase along the width until the thickness matches the secondary thickness. The outwardly extending flange has two ends that are generally defined by the width of the flange. These ends can have a curvilinear shape that forms an angle of less than ninety degrees away from the rear wall of the container lid. The gradual curve to the ends of the flange can prevent skin and fabric from catching on the flange.

The wet wipe container also includes a container base that includes a bottom and a front wall, rear wall and a pair of opposed side walls. The walls extend upward from the bottom of the container base in a generally rectangular configuration that provides an interior for containing the wet wipes. The walls can also extend upward in a generally trapezoidal configuration. The rear wall of the container base can have a top portion that includes an outwardly extending lip. The container lid can be attached to the container go base by attaching the attachment area of the container lid to the outwardly extending lip of the rear wall of the container base. The container lid and the container base can be attached to each other by various methods known in the art including an interlocking hinge, by pins and by ultrasonic bonding.

The container lid and the container base can be either transparent or translucent to provide an indication of the quantity of wet wipes remaining in the container. The container lid and the container base can be made of various polymers, copolymers, and mixtures including polystyrene and mixtures including polystyrene. The various corners formed by the front walls, rear walls, side walls, the top and the bottom of the container lid and the container base can be curvilinear.

In another aspect, the present invention relates to a wet wipe container that includes a container base, a container lid and a closure. The container lid is connected to the container base and either the container lid itself can include a hinge or a hinge can be formed between the container lid and the container base. As an example of the connection between lid and base, the container lid and the container base can be ultrasonically bonded together. The closure is configured to releasably hold the container lid on the container base in a closed position.

The closure includes an upright tongue projection that is continuous with and extends upward from a top surface of a front wall of the container base. The upright tongue projection can have curved edges and a flattened grip area that is generally in the center of the tongue projection. The top surface of the front wall of the container base can have an arcuate depression below the grip area of the tongue projection. The closure also includes an assistive region that is below the arcuate depression and is generally concentric with the tongue projection. The closure also includes an aperture that is located in a convex portion of a front wall of the container lid. When the container is closed, the tongue projection extends upward through the aperture. In another embodiment, the tongue projection extends downward from the container lid and the aperture is located within a convex portion of the container base.

The container lids of containers having such closures can further include a top and a rear wall and a pair of opposed side walls that extend downwardly from the top in a generally rectangular configuration. The container bases of containers having such closures can further include a bottom and a rear wall and a pair of opposed side walls that extend upwardly from the bottom in a generally rectangular configuration to provide an interior for containing the wet wipes. The container base can also have a generally trapezoidal configuration.

As with the other containers of the invention, the container lid and the container base can be transparent or translucent to provide an indication of the quantity of wet wipes remaining in the container. The container lid and the container base can be made of various polymers, copolymers, and mixtures including polystyrene and mixtures including polystyrene. The various corners formed by the front walls, rear walls, side walls, the top and the bottom of the container lid and the container base can be curvilinear.

In yet another aspect, the present invention relates to a wet wipe container that includes a container base and a container lid that is connected to the container base. The container base includes a bottom and a front wall, rear wall and a pair of opposed side walls. The walls extend upwardly from the bottom in a generally rectangular configuration to provide an interior for containing the wet wipes. The walls can include one or more generally linear ribs that are formed into the walls. The ribs can be vertical or horizontal.

The ribs can extend along the entire length or width of the wall(s) or the ribs can extend only along a portion of the length or width of the wall(s). The ribs provide the container with improved compression strength to resist the crushing or buckling that may occur during shipping and storage. The ribs also provide a more aesthetic appearance to the container.

Thus, the present invention, in its various aspects, advantageously relates to a container for wet wipes that, when compared to conventional containers of wet wipes, provides convenient single handed access to the wet wipes. In particular, the present invention provides an aesthetically pleasing container for wet wipes that has an easy-to-use and ergonomic closure. The improved closure provides reliable single handed opening and dispensing for improved consumer acceptance. The containers are particularly desirable for baby wipes intended for use in the typical diaper changing routine in which usually only one of the hands of the care-giver is available for retrieval of a wet wipe. Further, the container of the invention is stable in a partially open position regardless of the quantity of wet wipes in the container. Being able to maintain a partially open position of the lid prevents the weight of the container lid from tipping the container backwards when only a small quantity of wet wipes remain in the container. The container also provides improved alignment between the container lid and the container base, thereby further assisting single hand operation. Advantageously, the container of the invention has a lid that is more tear resistant under repeated use than conventional lids and a curved edge contour that prevents skin or fabric from catching on an edge of the container. Additionally, the container of the invention provides better compression strength and, therefore, improved resistance to crushing and buckling.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the containers of the invention. Together with the description, the drawings serve to explain the various aspects of the invention.

BRIEF DESCRIPTION OF THE DRAWINGS

The present invention will be more fully understood and further advantages will become apparent when reference is made to the following detailed description of the invention and the accompanying drawings. The drawings are merely representative and are not intended to limit the scope of the claims. Like parts of the containers depicted in the drawings are referred to by the same reference numerals.

DETAILED DESCRIPTION OF THE INVENTION

Figure 1:
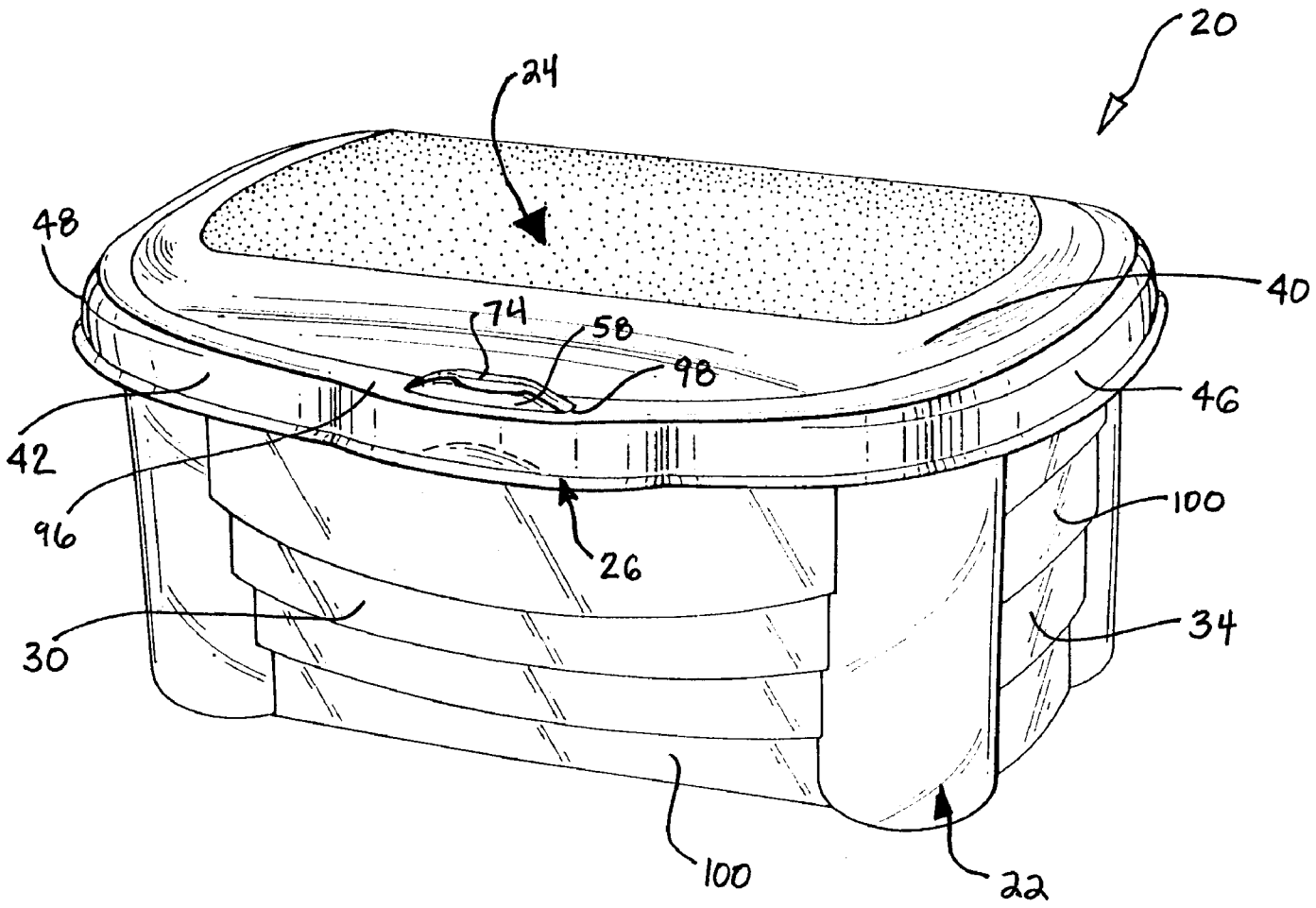
FIG. 1 representatively shows a perspective view of an example of a container for wet wipes according to the present invention in a closed position.
Figure 2:
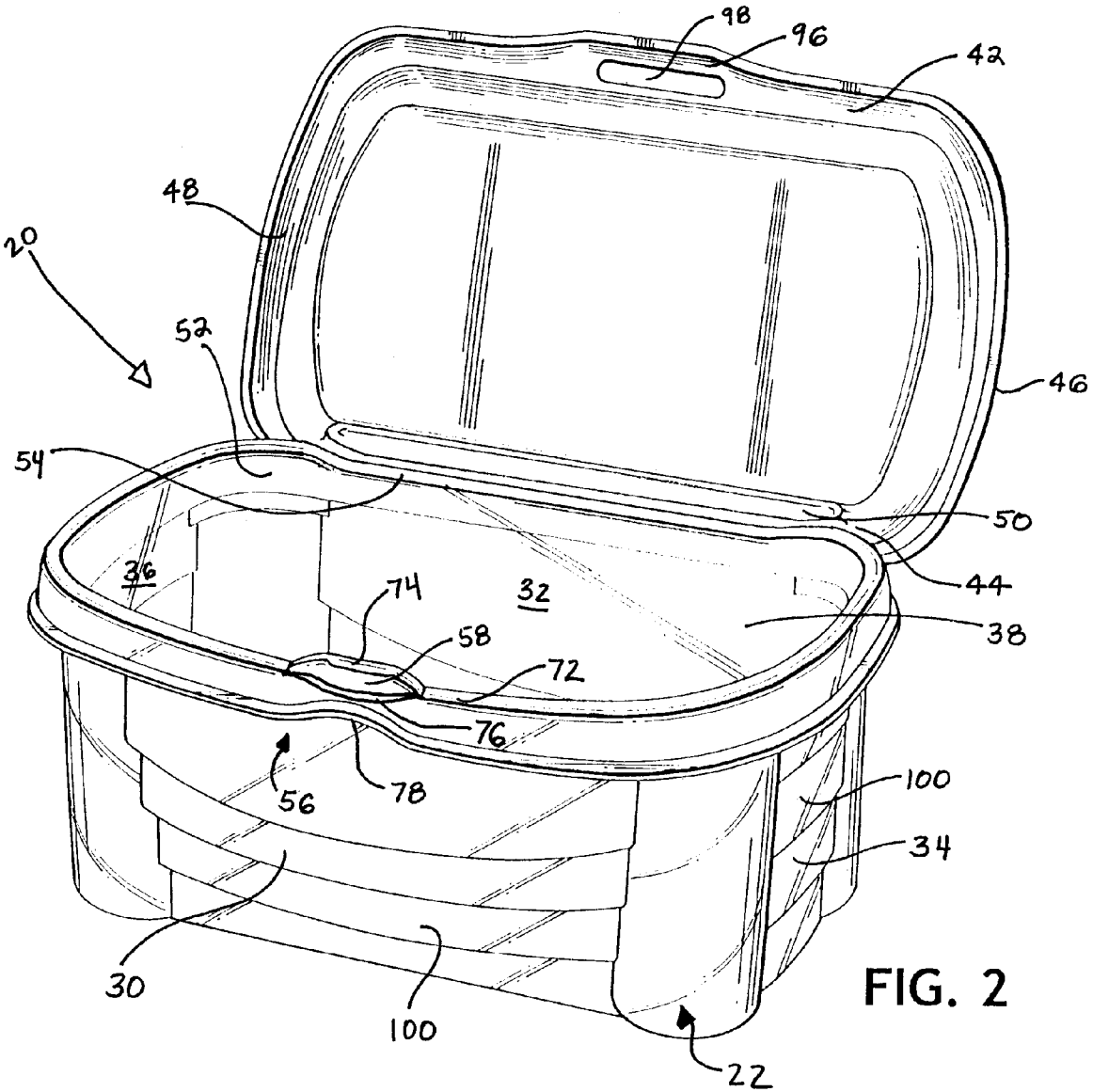
FIG. 2 representatively shows a perspective view of the container for wet wipes illustrated in FIG. 1 in an open position.
Figure 3:
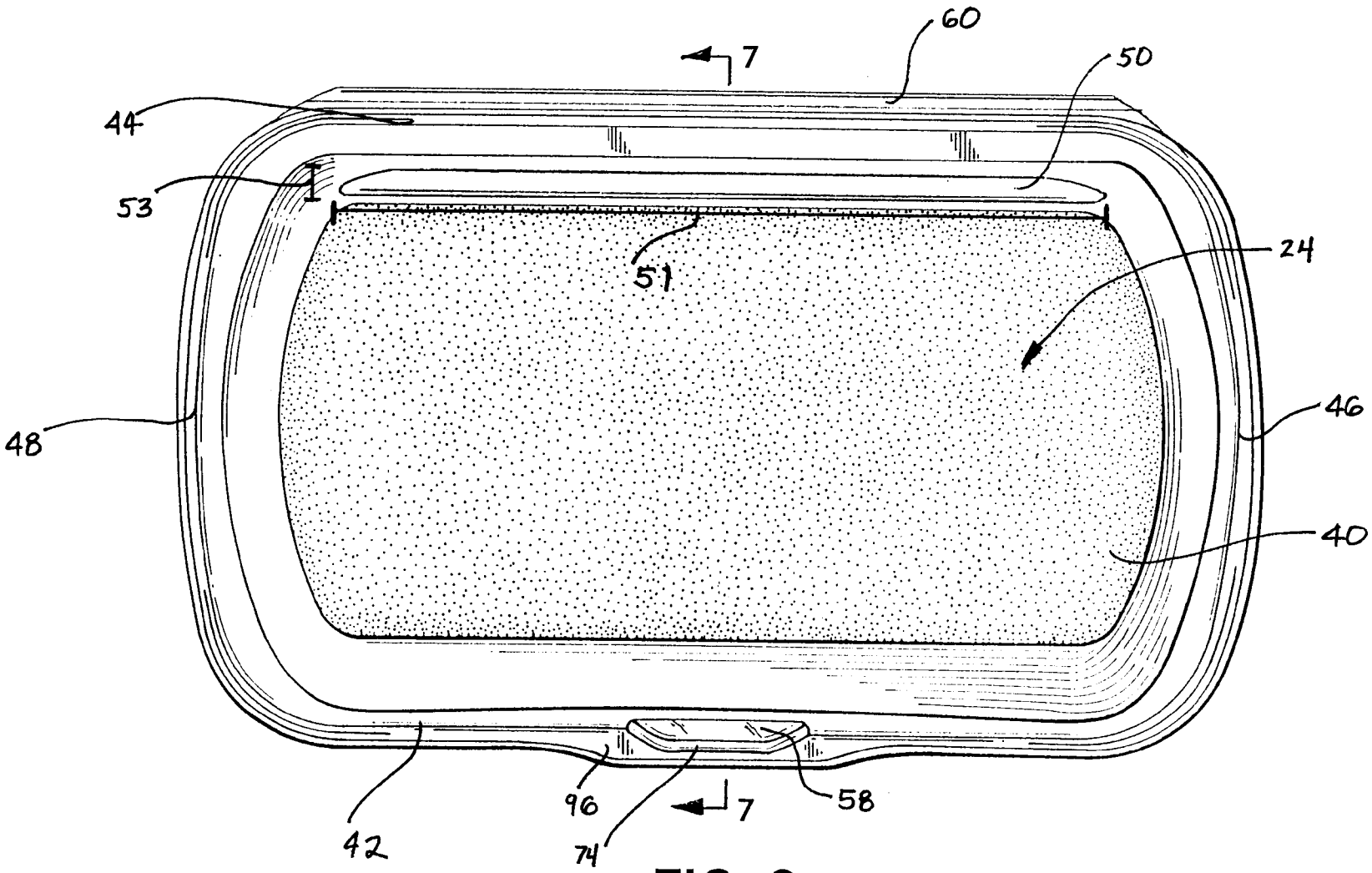
FIG. 3 representatively shows a top plan view of the container for wet wipes illustrated in FIG. 1.
Figure 4:
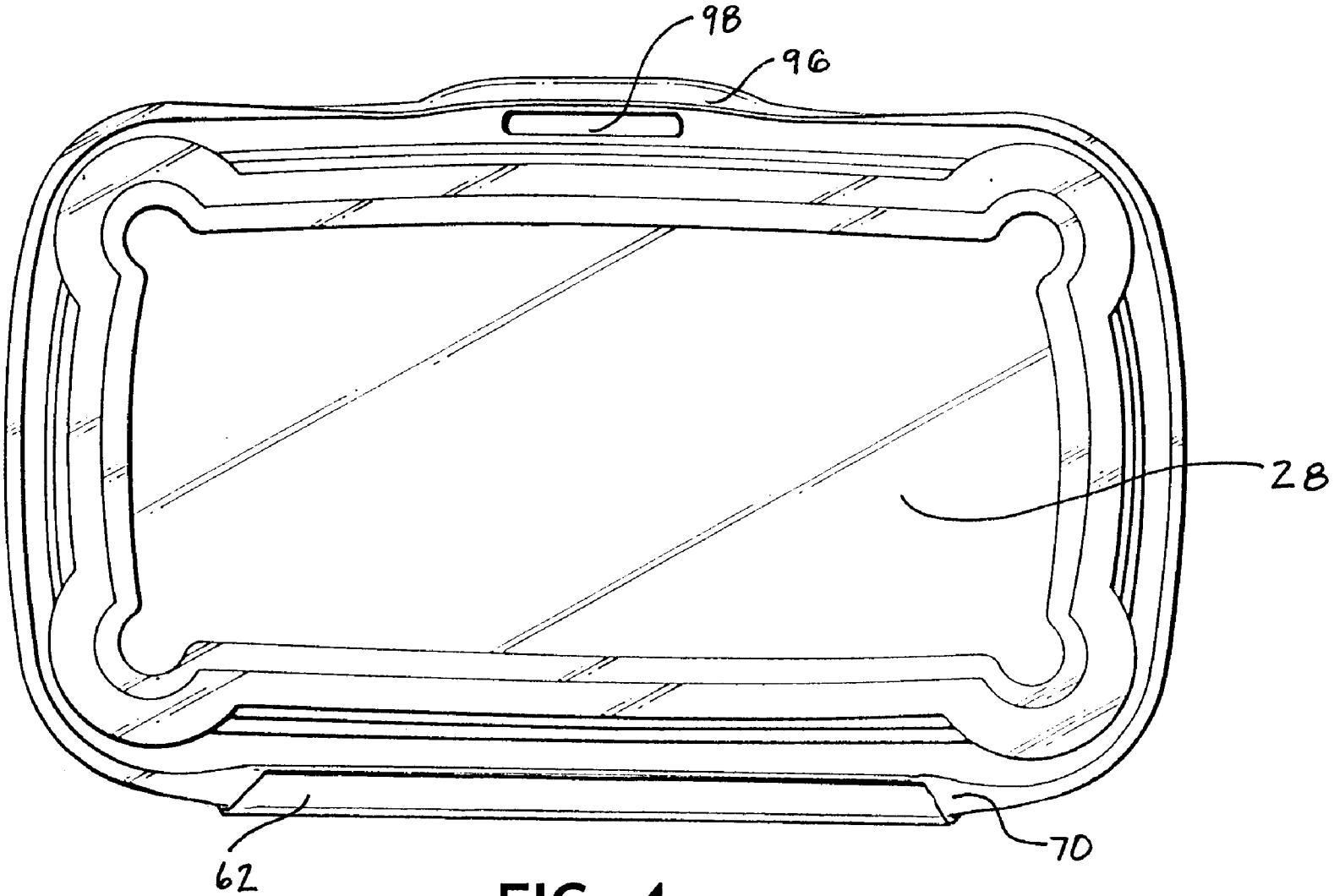
FIG. 4 representatively shows a bottom plan view of the container for wet wipes illustrated in FIG. 1.
Figure 5:
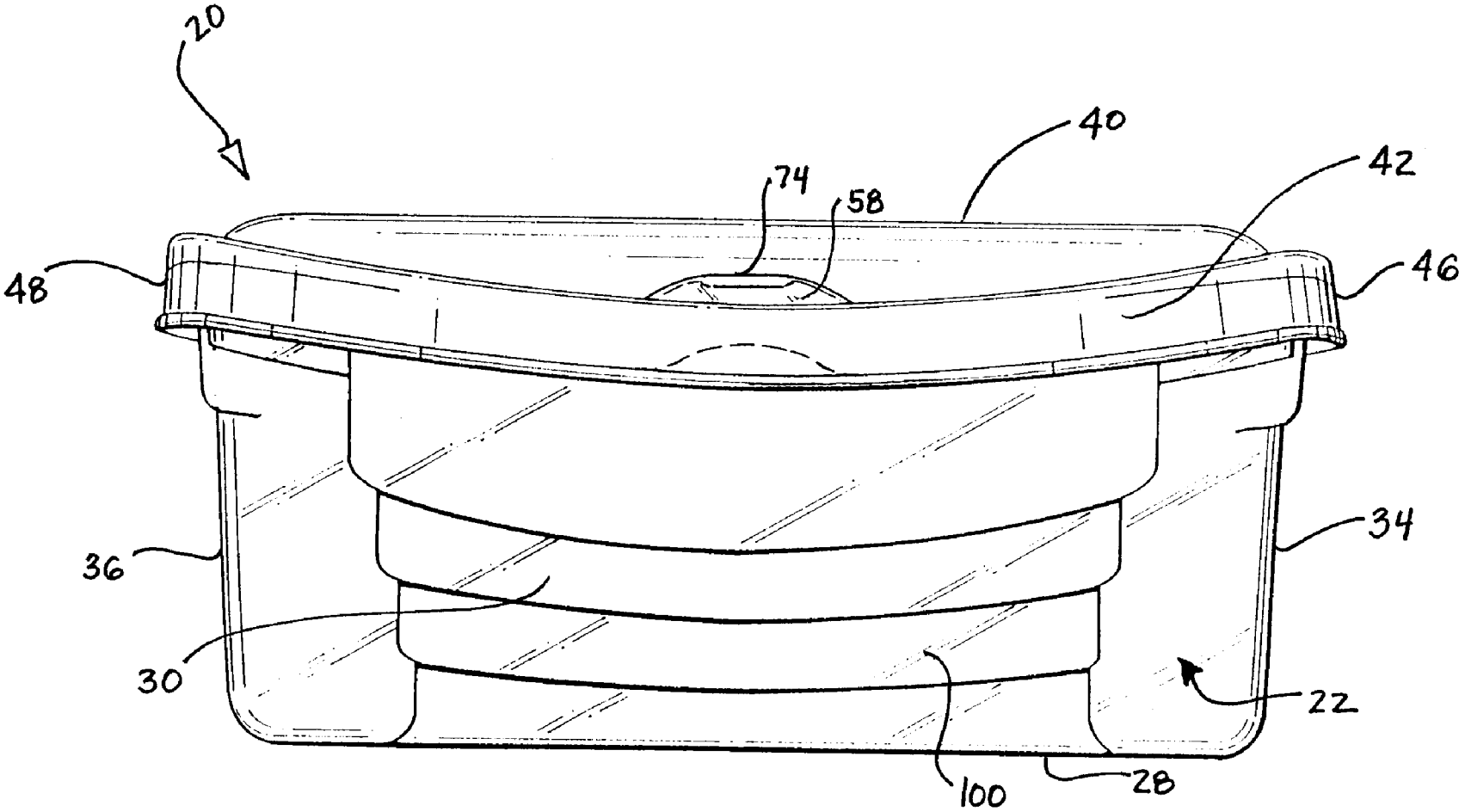
FIG. 5 representatively shows a front elevational view of the container for wet wipes illustrated in FIG. 1.
Figure 6:
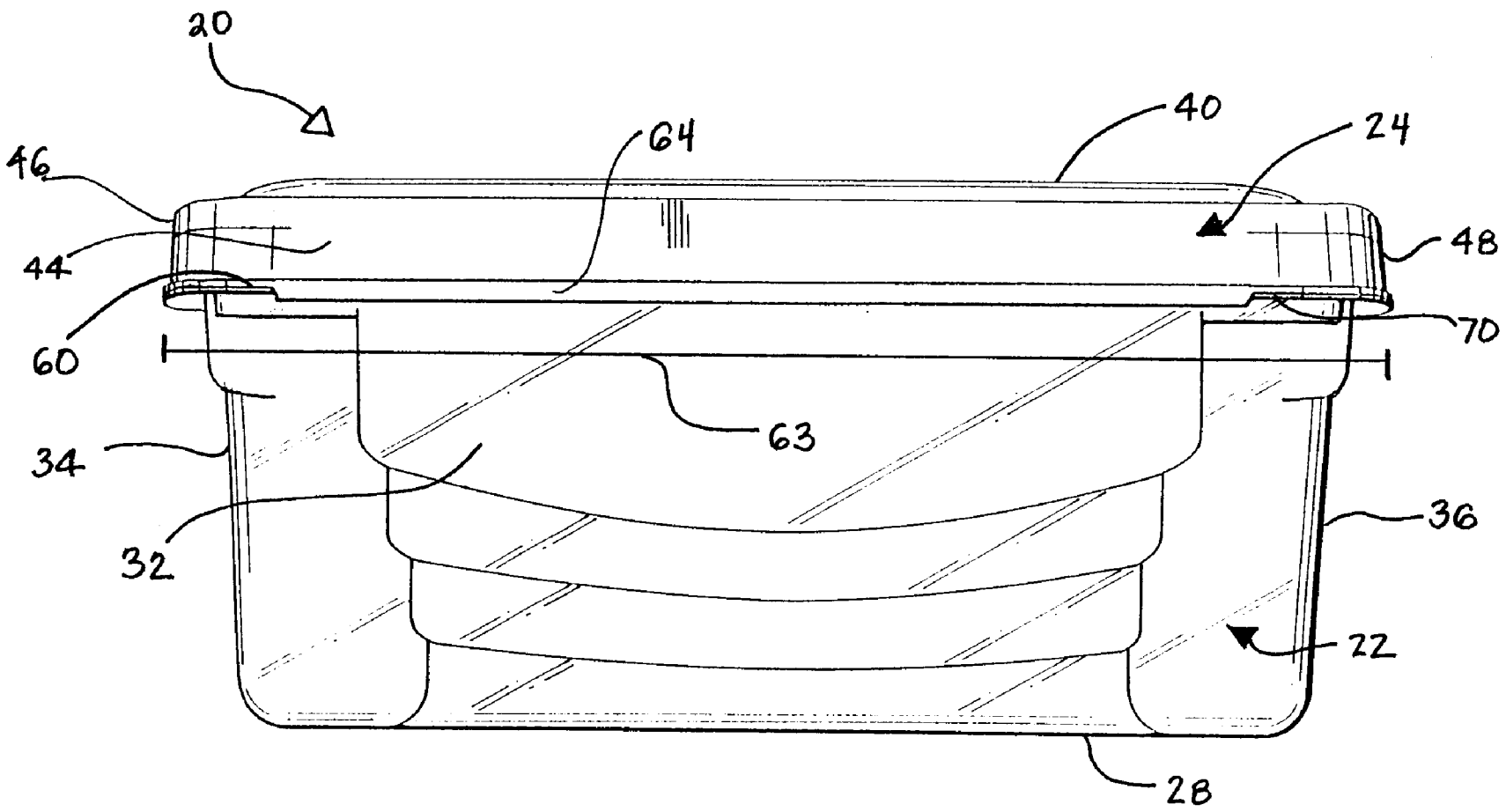
FIG. 6 representatively shows a rear elevational view of the container for wet wipes illustrated in FIG. 1.
Figure 7:
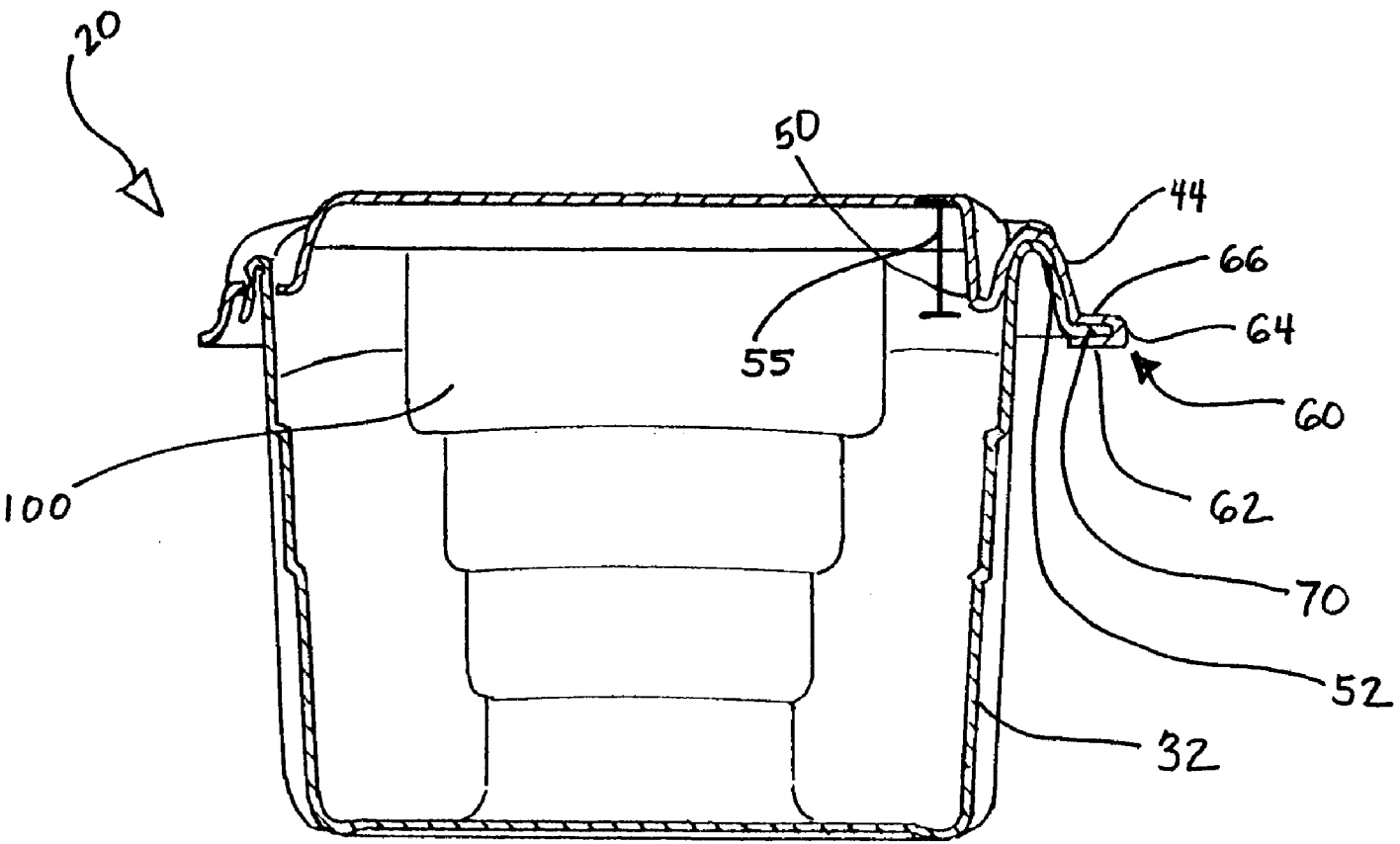
FIG. 7 representatively shows a cross-sectional end view of the container for wet wipes illustrated in FIG. 1.

The present invention is directed at solving problems related to the use and durability of conventional containers for wet wipes. As representatively illustrated in FIGS. 1–8, the present invention provides a wet wipe container 20 that is configured to dispense wet wipes in a convenient and reliable manner for personal use. The wet wipe container 20 includes a container base 22 and a container lid 24 that is connected or attached to the container base 22. The container base 22 and the container lid 24 can be formed as a single piece or they can be separate pieces. The container lid 24 can be connected to the container 22 by various mechanical and chemical methods known in the art, including, but not limited to, hinges, interlocking members, use of glue or other bonding material or ultrasonic bonding.

The wet wipes may be arranged in the container 20 in any manner which provides convenient and reliable one at a time dispensing and which ensures that the wet wipes do not become overly dry. For example, the wet wipes may be arranged in the container 20 as a plurality of individual sheets arranged in a stacked configuration to provide a stack of wet wipes which may or may not be individually folded. The wet wipes may be individual wet wipes which are folded in a c-fold or z-fold configuration as are known to those skilled in the art and then stacked on top of each other to provide the stack of wet wipes. Alternatively, if the wet wipes are to be arranged in a stacked configuration in the container 20, the individual wet wipes may be interfolded such that the leading and trailing end edges of successive wipes in the stacked configuration overlap. In such a configuration, the leading end edge of the trailing wet wipe is loosened from the stack by the trailing end edge of the leading wet wipe as the leading wet wipe is removed by the user. The wet wipes may be interfolded to facilitate such dispensing by means known to those skilled in the art.

Alternatively, the wet wipes may be arranged in the container 20 as a continuous web of interconnected wet wipes which are folded in an accordion-like stacked configuration. The individual wet wipes may be connected together along lines of frangibility, such as lines of perforations, to ensure that the trailing wet wipe is in position for grasping by the user after the leading wet wipe is removed. For example, the wet wipes may be provided by a continuous web of material which has a series of lines of frangibility extending across the width of the web. The portion of the web of material between successive lines of frangibility provides each individual wet wipe. The lines of frangibility may be provided by means known to those skilled in the art such as perforations, indentations or cuts in the web of material. For example, the lines of frangibility or perforations may be provided in the web of material by passing the web of material between a die cutter roll and anvil roll. After the lines of frangibility have been incorporated into the web of material, the web may then be arranged in a stacked configuration for easy insertion into the interior 38 of the container 20.

The wet wipe container 20 of the present invention can comprise any suitable number of individual wet wipes depending upon the desired packaging and end use. For example, the container 20 may be configured to include a stack of wet wipes which may include at least about 5 wet wipes and desirably from about 16 to about 320 individually wet wipes.

Each wet wipe is generally rectangular in shape and defines a pair of opposite side edges and a pair of opposite end edges which may be referred to as a leading end edge and a trailing end edge. The leading end edge of each wet wipe is typically positioned in the container 20 to be grasped by a user to facilitate a removal of the wet wipe from the container 20. Each wet wipe defines an unfolded width and an unfolded length. The wet wipe may have any suitable unfolded width and length. For example, the wet wipe may have an unfolded length of from about 2.0 to about 80.0 centimeters and desirably from about 10.0 to about 25.0 centimeters and an unfolded width of from about 2.0 to about 80.0 centimeters and desirably from about 10.0 to about 45.0 centimeters.

Materials suitable for the wet wipes of the present invention are well known to those skilled in the art. The wet wipes can be made from any material suitable for use as a moist wipe, including meltblown, coform, air-laid, bonded-carded web materials, hydroentangled materials and the like and can comprise synthetic or natural fibers or combinations thereof. The wet wipes may have a basis weight of from about 25 to about 120 grams per square meter and desirably from about 40 to about 90 grams per square meter.

In a particular aspect, the wet wipes may comprise a coform basesheet of polymeric microfibers and cellulosic fibers having a basis weight of from about 60 to about 80 grams per square meter and desirably about 75 grams per square meter. Such coform basesheets are manufactured generally as described in U.S. Pat. No. 4,100,324 to Anderson et al. which issued Jul. 11, 1978, and which is herein incorporated by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet may comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes.

The wet wipes of the different aspects of the present invention contain a liquid which can be any solution which can be absorbed into the wet wipes. The liquid contained within the wet wipes may include any suitable components which provide the desired wiping properties. For example, the components may include water, emollients, surfactants, preservatives, chelating agents, pH buffers or combinations thereof. The liquid may also contain lotions, ointments and/or medicaments.

The amount of liquid contained within each wet wipe may vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 250 to about 450weight percent liquid based on the dry weight of the wipe for improved wiping. In a particular aspect wherein the wet wipe is made from a coform material comprising from about 30 to about 40 weight percent polymeric microfibers based on the dry weight of the wipe, the amount of liquid contained within the wet wipe is from about 300 to about 400 weight percent and desirably about 330 weight percent based on the dry weight of the wet wipe. If the amount of liquid is less than the above-identified range, the wet wipes may be too dry and may not adequately perform. If the amount of liquid is greater than the above-identified range, the wet wipes may be oversaturated and soggy and the liquid may pool in the bottom of the container.

As illustrated in FIGS. 1–8, the wet wipe container 20 includes a container base 22 that defines a bottom 28 that is connected to a front wall 30, a rear wall 32, and a pair of opposed side walls 34 and 36. The front, rear and side walls extend upwardly from the bottom 28 in a generally perpendicular manner to form a rectangular container base 22. The container base 22 can also have a trapezoidal shape. The bottom and front, rear and side walls of the container base 22 generally define an open interior 38 for containing the wet wipes. The wet wipe container 20 also includes a container lid 24 that defines a top 40 that is connected to a front wall 42, a rear wall 44 and a pair of opposed side walls 46 and 48. The front, rear and side walls extend downwardly from the top 40 in a generally perpendicular manner to form a rectangular container lid 24.

The container base 22 and container lid 24 of the container 20 may be provided by a variety of materials that are inexpensive and capable of retaining liquids. Suitable materials include polypropylene, polyethylene, polystyrene and the like or combinations thereof. For example, the container base 22 may be fabricated from a polystyrene material having a thickness of from about 0.010 inches to about 0.080 inches. The container lid 24 may be fabricated from a combination of a styrene-butadiene-styrene copolymer with a polystyrene material having a thickness of from about 0.005 inches to about 0.060 inches.

The walls 30, 32, 34 and 36 of the container base 22 may be integral with the bottom 28 or may include separate members that are connected or joined to the bottom 28 to provide the container base 22. Similarly, the walls 42, 44, 46 and 48 of the container lid 24 may also be integral with the top 40 or may include separate members that are connected or joined to the top 40 to provide the container lid 24. Desirably, the connections or corners between the walls and the top 40 and bottom 28 of the base 22 and lid 24 are curvilinear to provide a more aesthetically pleasing container 20.

The different components of the container 20 may be provided by conventional techniques such as thermoforming or injection molding as they are known to those of skill in the art. With respect to the containers of the invention, in some embodiments the container base 22 and container lid 24 are provided as integral units. In some cases, injection molding techniques can be used to form the integral units. When the container base 22 and container lid 24 are separate components, thermoforming techniques typically are used.

In an embodiment of the containers of the invention, the container 20 includes a container base 22 and a container lid 24 as described herein. In addition to a top 40 and front wall 42, rear wall 44 and side walls 46, 48, the container lid 24 can also include a downwardly extending guide ridge 50. The guide ridge 50 generally is parallel to the rear wall 44 of the container lid 24. The guide ridge 50 is generally located close to or proximate the rear wall 44. The rear wall 32 of the container base 22 has an upper portion 52. The upper portion 52 is the uppermost portion of the rear wall 32 and, therefore, the portion of the rear wall 32 that comes in closest contact with the container lid 24. The upper portion 52 extends along the full length of the rear wall 32. The upper portion 52 defines a receiving edge 54. The receiving edge 54 is configured to receive the guide ridge 50 of the container lid 24. For example, the receiving edge 54 can be arc-shaped to receive the guide ridge 50. The receiving edge 54 receives the guide ridge 50 as the container lid 24 is closed upon the container base 22.

In one embodiment of the invention, as the container lid 24 is rotated downward toward a closed position, the guide ridge 50 comes into contact with the receiving edge 54 and the receiving edge 54 urges the guide ridge 50 downward and ahead of the receiving edge 54. Therefore, the guide ridge 50 is spaced sufficiently away from the rear wall 44 to be able to land in front of the receiving edge 54 when the container lid 24 is closed on the container base 22. Because the guide ridge 50 extends downward from the top 40 of the container lid 24, the guide ridge 50 can be described as having a "depth" as opposed to a height. The depth of the guide ridge 50 is sufficient to extend below the lowest point or bottom of the receiving edge 54. The combination of the guide ridge 50 and the receiving edge 54 increases the ease with which the container lid 24 can be closed on the container base 22. Further, the guide ridge 50/receiving edge 54 combination assists with the alignment of the container lid 24 onto the container base 22 for purposes of providing a secure closed position. Because the container lid 24 and the container base 22 are aligned properly, the container lid 24 can completely cover the container base 22 and there is a reduced likelihood that the container lid 24 will "pop" off the container base 22. If the container lid 24 becomes partially or entirely detached from the container base 22, moisture will be lost from the wet wipe product stored in the container 20. As a consequence, the wet wipe product loses its ability to perform its intended function.

The combination of the guide ridge 50 and the receiving edge 54 also assists with single hand use of the container 20 by permitting a partially open relationship between the container lid 24 and the container base 22. Typically, existing containers are only capable of maintaining either a completely open or a completely closed position. When only a low quantity of wet wipes remain in a container 20 and the container lid 24 is in the open position, the entire container 20 can tip backwards from the weight of the container lid 24 not being sufficiently counterbalanced. Tipping of the container 20 makes single hand grasping of the wet wipes difficult. The partially open position is achieved when the guide ridge 50 rests on the receiving edge 54. With containers of the invention, the difficulties associated with the container 20 tipping over are overcome while the user can still remove wet wipes from the container 20 with one hand. The container 20 of the invention does not tip over even when no wet wipes remain in the interior 38 of the container 20. Generally, when the container lid 24 is in the partially open position, it is approximately 1.5 inches to 3.0 inches away from the container base 22. For at least these reasons, the containers of the invention are easier to use with a single hand and they are more stable when small numbers of wet wipes remain in the container 20.

The guide ridge 50 and the receiving edge 54 can have a variety of configurations. Typically, the receiving edge 54 is shaped or contoured to at least partially complement the downward facing contour or shape of the guide ridge 50. While the receiving edge has a thickness, the receiving edge 54 is primarily two dimensional. The receiving edge 54 can extend the full length of the upper portion 52 of the rear wall 32 or extend only along part of the length of the upper portion 52. The guide ridge 50 has a length 51 (shown in FIG. 3), a depth 55 (depicted in FIG. 7) and a thickness 53 (depicted in FIG. 3). Generally, the length 51 of the guide ridge 50 is less than the length of the rear wall 44. The guide ridge 50 can desirably have a ratio of the length 51 of the guide ridge 50 to the length of the rear wall 44 of from about 40% to about 90%. In most embodiments, the depth 55 of the guide ridge 50 ranges from about 0.25 inches to about 0.75 inches. The thickness 53 of the guide ridge 50 can range from about 0.0625 inches to about 0.25 inches. The position of the guide ridge 50 against the rear wall 32 of the container base 22 when the container lid 24 is closed is visible in the representative cross-section of a container 20 end depicted in FIG. 7.

As described herein, the containers of the invention can be manufactured out of polymers, copolymers or mixtures of polymers and copolymers. Additional components can be added to provide various functionalities to either the overall container 20 or the individual container base 22 and container lid 24. In one example, the container base 22 is formed from approximately 98% of a high impact polystyrene such as is available from Dow Chemical of Midland, Mich. as Dow SYTRON® 484. The remainder of the composition of the container base 22 can be an impact modifier such as STEREON® which is available from the Firestone Company. In an example of a container lid 24 of the invention, the container lid 24 is made of approximately 70% of a styrene-butadiene-styrene copolymer such as FINAPRENE™ Thermoplastic Elastomers, Finaclear 520 available from the Fina Oil and Chemical Company. The container lid 24 can also include approximately 20% of a general purpose polystyrene such as FINA® Polystyrene 524B available from the Fina Oil and Chemical Company. The container lid 24 can further include approximately 10% of a high impact polystyrene such as the Dow SYTRON® 484. If desired, the container lid 24 can include a colorant in an amount of from about 0.08% to about 1.2% by weight. Suitable colorant compounds are known to those of skill in the art.

One or the other of the container lid 24 and the container base 22 of the containers of the invention can be transparent, translucent or opaque. There are certain advantages associated with either of the container lid 24 or the container base 22 being transparent or translucent. For example, when the container lid 24 is transparent, the user of the container 20 can readily determine the quantity of wet wipes remaining in the container 20. That is, the user can determine the quantity of wet wipes remaining in the container 20 without having to open the container lid 24 of the container. This is useful, in part, because some wet wipe products are sold without containers in refill packs. The consumer may make intermittent purchases of the wet wipes in a container 20, such as described herein but may also make supplemental purchases of the wet wipes in refill packs. The consumers may refill the container 20 with wet wipes purchased as part of the refill packs. When the container lid 24 and container base 22 are translucent, the container 20 of the invention is desirable for secondary uses. For example, when a consumer no longer uses the container 20 for holding wet wipes, the consumer may want to use the container 20 to store small toys, art supplies and other household items. If the container 20 is translucent, one can see what is inside of the container 20 without having to open the lid 24 or without having to relocate items that may be on top of or around the container 20.

Aesthetic and functional advantages are also obtained when one or the other of the container lid 24 or container base 22 are colored. For example, differently colored containers can be used to distinguish the packaging for different types of wet wipe products. Similarly, aesthetic and functional advantages can be achieved when the container lid 24 or the container base 22 have graphics printed on them. In addition to aesthetic benefits, the graphics can be used to distinguish between various wet wipe product types.

As already described herein, the container lid 24 and the container base 22 can be formed of a single integral piece or be formed as separate pieces. With respect to containers of the invention that are formed from two separate pieces, the container lid 24 is attached or connected to the container base 22 using a variety of techniques known to those of skill in the art. In some embodiments, the container lid 24 and the container base 22 are attached at their rear walls. The rear wall 44 of the container lid 24 can be attached to the rear wall 32 of the container base 22 through the use of glues, adhesives or other bonding agents; through heat sealing; through ultrasonic bonding; or through the use of physical connectors such as pins or interlocking members.

In another embodiment of the present invention, the container 20 includes a container base 22 and a separate container lid 24 that is attached to the container base 22. As representatively illustrated in FIGS. 6–8, the rear wall 44 of the container lid 24 has an outwardly extending flange 60. The outwardly extending flange 60 is generally two-dimensional and the flange 60 has a width 61 and a length 63. The outwardly extending flange 60 extends away from the plane of the rear wall 44 in a primarily perpendicular direction. The flange 60 includes three general areas: the area nearest the rear wall 44, that is, the immediately adjacent area 66; the hinge channel 64; and the attachment area 62. The attachment area 62 is located furthest away from the rear wall and the hinge channel 64 is centrally located between the immediately adjacent area 66 and the attachment area 62. Each of the three areas or sections of the flange 60 is primarily linear in shape and each area has an individual length, width and thickness. The three areas are generally parallel to each other and extend in a direction that is primarily parallel to the rear wall 44 of the container lid 24. The rear wall 32 of the container base 22 has a top or upper portion 52 that runs linearly along the portion of the rear wall 32 that is furthest away from the bottom 28. The top portion 52 has an outwardly extending lip 70. The outwardly extending lip 70 is generally planar and extends away from the top portion 52 in a direction that is primarily perpendicular. The container lid 24 is attached to the container base 22 by attachment of the flange 60 to the outwardly extending lip 70. More specifically, the attachment area 62 of the flange 60 is attached to the outwardly extending lip 70. Therefore, in general terms, the container lid 24 and the container base 22 are attached to each other along their rear walls. The attachment area 62 and the outwardly extending lip can be attached to each other using any of the techniques generally known to those of skill in the art. One example of a suitable technique is ultrasonic bonding.

In one embodiment of the invention, the end edges of the flange 60 can be tapered. The tapering of the flange 60 ends results in the ends of the flange 60 being curved. When an end of the flange 60 has a curvilinear shape, the end forms an angle 69, depicted in FIG. 8, away from the rear wall 44 that is less than ninety degrees. In conventional containers, the edge of the hinge between the container lid and container base can be perpendicular, or at ninety degrees, with the back panel of the container lid. Provision of a curvilinear shape and angle of less than ninety degrees provides several advantages to the container 20. Curvature of the end edges of the flange 60 gives a more user-friendly container 20 in that the flange 60 is less likely to catch on fabric or skin. When the flange 60 edges are tapered along a curve, the immediately adjacent area 66 has the greatest length and the attachment area 62 has the smallest length. While the length of the flange 60 does not typically exceed the length of the rear wall 44, the lengths of the three areas can vary depending on whether and how the tapering is executed. For example, in a particular embodiment, the length of the hinge channel 64 can be from about 60% to about 85% of the length of the rear wall 44. The length of the attachment area 62 can be from about 50% to about 75% of the length of the rear wall 44.

Figure 8B:
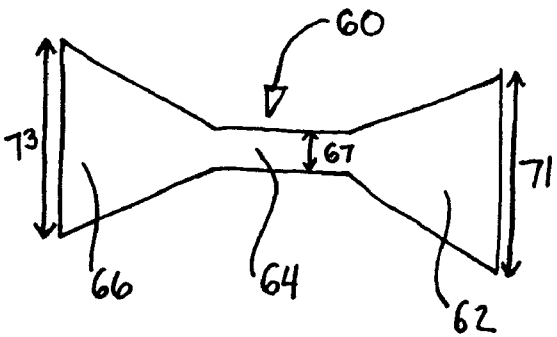
FIG. 8 representatively shows an expanded top plan view of the container lid of the container for wet wipes illustrated in FIG. 1.
Figure 8A:
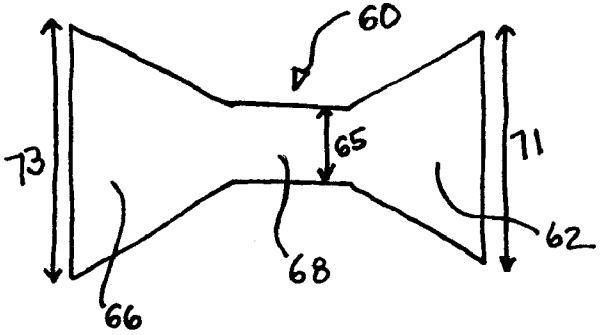
Figure 8:
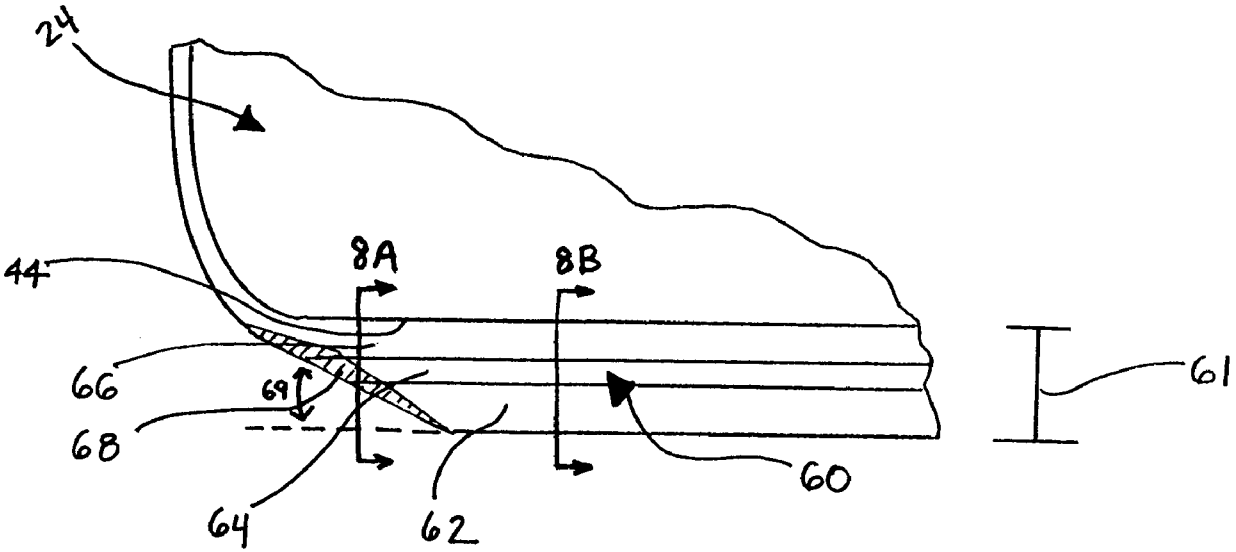

In an additional embodiment of the invention, the hinge channel 64 has two ends, each end of the hinge channel 64 including an end region 68. The hinge channel 64 has a primary thickness and the end regions 68 have a secondary thickness. The secondary thickness of the end regions 68 is generally greater than the primary thickness of the hinge channel 64. For example, the primary thickness of the hinge channel 64 can be from about 0.005 inches to about 0.015 inches. The secondary thickness of the end regions 68 is from about 20% to about 100% greater than the primary thickness. In a similar embodiment, the overall thickness of the outwardly extending flange 60 varies along the width of the flange 60. As with the tapered flange 60 length described herein, the thickness of the flange 60 can have a gradual change across the three areas of the flange 60. An example of the gradual change or tapering of the thickness of the flange 60 is depicted in FIG. 8.

In one example of a flange 60 of the invention, the immediately adjacent area 66 has an initial thickness 73 of about 0.040 inches at the point nearest the rear wall 44. The end region 68 of the hinge channel 64 has a thickness 65 of about 0.015 inches; the remainder of the hinge channel 64 has a thickness 67 of about 0.009 inches. The thickness of the flange 60 can then increase over the transition from the end region 68 or hinge channel 64 to the attachment area 62. The attachment area 62 is shown in FIGS. 8A and 8B as having a thickness 71 that is approximately the same as the thickness 73 of the immediately adjacent area 66, however the thicknesses 71 and 73 can be different. As shown in FIG. 8A, the thickness 73 of the flange 60 in the immediately adjacent area 66 can gradually thin from about 0.040 inches to about 0.015 inches, the thickness 65 of the end region 68. The thickness 65 of the flange 60 can remain fairly constant over the width of the end region 68. On the other side of the end region 68, the thickness 71 of the flange 60 would gradually increase across the width of the attachment area 62 until the thickness 71 reached a value of about 0.040 inches. The variation in the thickness 73 of the immediately adjacent area 66, the thickness 67 of the hinge channel 64 and the thickness 71 of the attachment area 62 over the width of the flange 60 is depicted generally in FIG. 8B.

Figure 9:
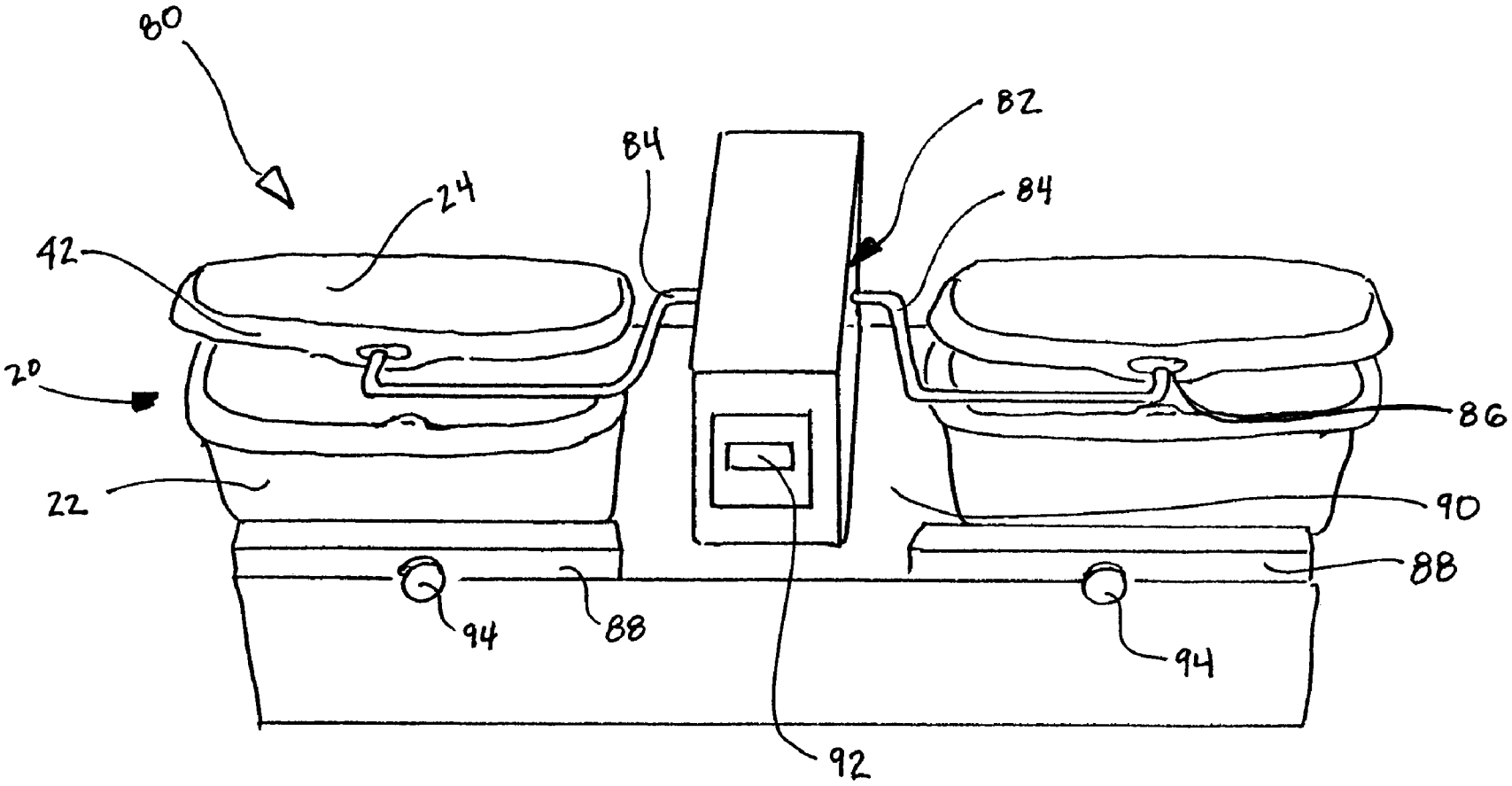
FIG. 9 shows a perspective view of an instrument used to measure tear resistance (closed position)
Figure 10:
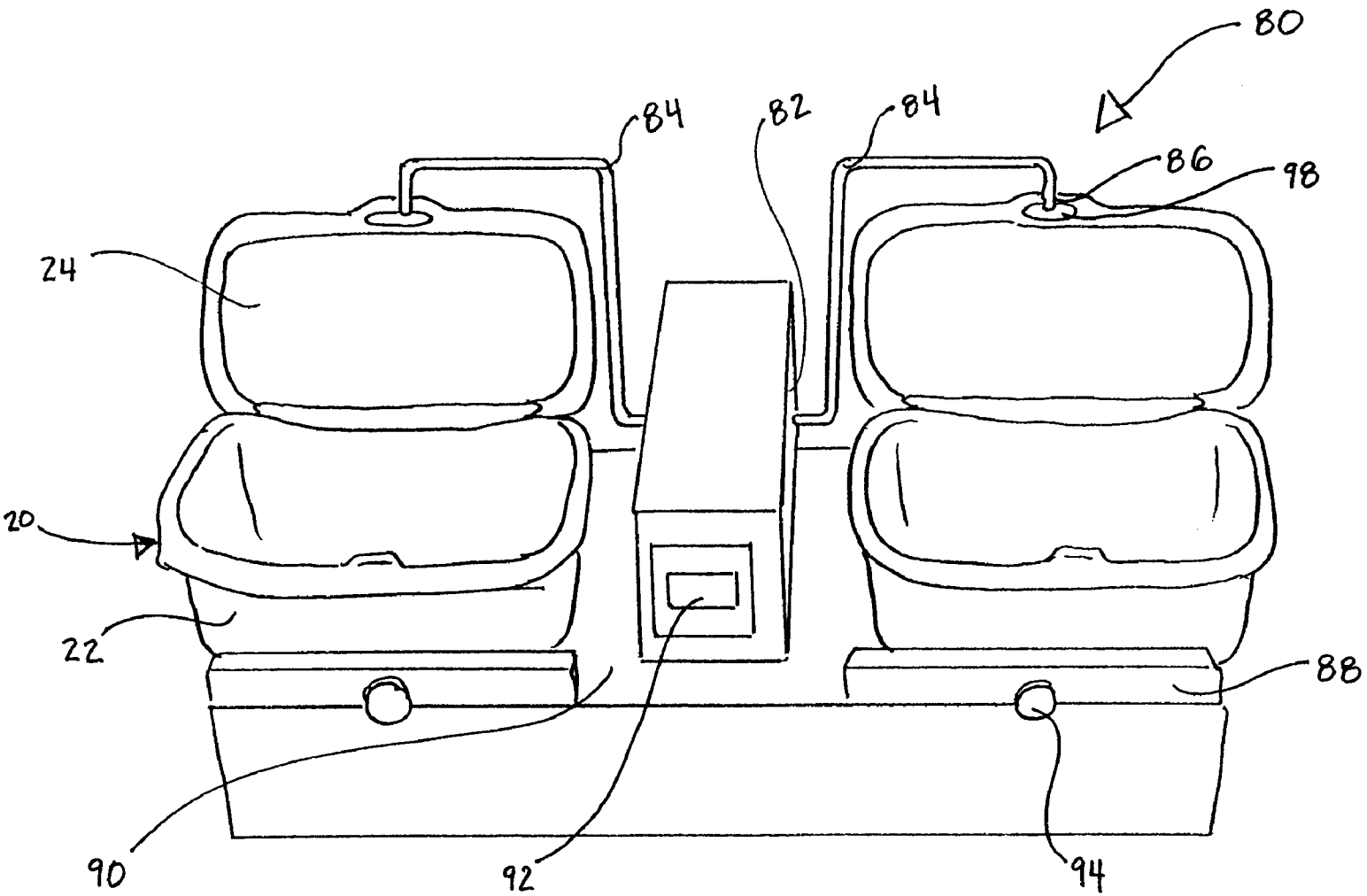
FIG. 10 shows a perspective view of an instrument used to measure tear resistance (open position).

With the containers of the invention, performance benefits are seen with a container lid 24 having an outwardly extending flange 60 from the rear wall 44 where the flange 60 has a hinge channel 64 with an end region 68 of a greater secondary thickness 65. When the hinge channel 64 has an end region 68 of a secondary thickness 65, the hinge channel 64 is more resistant to tearing. The hinged areas of conventional containers typically are susceptible to tearing after repeated use. Apparently, the hinge becomes strained over time to the point of tearing from the repeated opening and closing of the lid. In order to demonstrate the improved tear resistance of the containers of the invention, the apparatus depicted in FIGS. 9 and 10 was constructed to simulate repetitive opening and closing of a container lid 24. A representation of a flex test instrument 80 is shown in FIGS. 9 and 10. The flex test instrument 80 can simulate container lid 24 motion on two containers 20 at a time. The flex test instrument 80 includes a motor assembly 82 that is housed approximately in the center of the instrument platform 90. The motor art assembly 82 includes a gear motor, motor controller and miter gear. Suitable motor assembly 82 components can be purchased by part number from the following manufacturers: (1) Gear Motor—W. W. Grainger, Part #4Z539; (2) Motor Controller—W. W. Grainger, Part #4Z527; and (3) Miter Gear—W. M. Berg, Part #MX-3-D. The motor assembly 82 drives rotating motion arm 84 through a range of motion that emulates the range of motion experienced by a container lid 24 from repeated opening and closing. Relative to the vertical plane, the rotating motion arm 84 moves over a range of from about −78° to about +78°. Each cycle of the rotating motion arm 84 is detected and recorded by a counter 92. A suitable counter 92 is part number H7CS-B of the Omron Corporation of Japan, or an equivalent.

FIG. 9 shows operation of the flex test instrument 80 when the container lids 24 are in a virtually closed position and FIG. 10 shows the flex test instrument 80 when the container lids 24 are in an open position. In setting up the flex test instrument 80 to perform a test, the containers 20 are placed on the platform 90 of the instrument 80. The containers are placed between two spacer bars, one in front of the container 20 and one behind the container 20. The rear spacer bars are not visible in the figures. The front spacer bar is an adjustable spacer bar 88 and can be moved rearwardly through rotation of a knob 94 until a position is achieved that firmly holds the container 20 on the platform 90. Each branch of the rotating motion arm 84 terminates with a slotted end 86. The slotted end 86 slides over and clips to a portion of the front wall 42 of the container lid 24. In order to demonstrate the improved tear resistance associated with the containers of the invention, comparative tests were conducted between a conventional container and a container 20 of the invention using the flex test instrument 80. To represent a conventional container, a HUGGIES NATURAL CARE® container was tested. The container 20 of the invention had a separate container lid 24 with an outwardly extending flange 60. The outwardly extending flange 60 included a hinge channel 64 having a primary thickness 67, the hinge channel 64 having an end region 68 of a greater secondary thickness 65. The primary thickness 67 was about 0.009 inches and the secondary thickness 65 was about 0.015 inches. The flex test instrument 80 was operated at about 50 cycles/min. The conventional HUGGIES NATURAL CARE® container experienced tearing across the entire length of the hinged area after about 9,000 cycles. The representative container 20 of the invention experienced no tearing of the hinge channel 64 after about 28,000 cycles.

The present invention is also directed to a wet wipe container 20 having a container lid 24 that is connected to a container base 22 and a closure 56 that is configured to releasably hold the container lid 24 on the container base 22 in a closed position. As illustrated in FIGS. 1–8, the container lid 24 is hingedly connected to the container base 22. The container base 22 includes a front wall 30 that extends upward from a bottom 28. The front wall 30 has a top surface 72. The top surface 72 is in a position that is furthest away on the front wall 30 from the bottom 28. The closure 56 includes an upright tongue projection 58 that is continuous with and extends upward from the top surface 72. The tongue projection 58 has curved edges and is generally semi-circular in configuration. The tongue projection 58 is of a length suitable for gripping. The tongue projection 58 includes a flattened grip area 74. The flattened grip area 74 is approximately of a length that can be easily pushed against by a full size human finger or thumb. The flattened grip area 74 is generally located in the center of the tongue projection 58 and may have a width that is greater than the width of the tongue projection 58. The larger width of the grip area 74 can create a flat surface on the top of the tongue projection 58 for improved performance.

The top surface 72 may also include an arcuate depression 76 that is located primarily below the flattened grip area 74 of the tongue projection 58. In addition to the tongue projection 58 and the arcuate depression 76, the top surface may further include an assistive region 78. The assistive region 78 is positioned below the arcuate depression 76 and has a shape that is generally concentric, and therefore semi-circular, with the configuration of the tongue projection 58. The rise of the semi-circular assistive region 78 approaches but does not need to touch the arcuate depression 76. The closure 56 also includes an aperture 98. The aperture 98 is formed within the front wall 42 of the container lid 24. The front wall 42 has a convex portion 96 that extends somewhat outward and away from the front wall 42 in a perpendicularly-oriented direction. The aperture 98 is long enough to accommodate the length of the tongue projection 58. When the container 20 is in a closed position, the tongue projection 58 extends upward through the aperture 98. In another embodiment, the tongue projection 58 could extend downward from the front wall 42 of the container lid 42 and the aperture 98 could be located within the top surface 72 of the front wall 30 of the container base 22.

Either of the container lid 24 and the container base 22 can be transparent or translucent. Further, either of the container lid 24 and the container base 22 can be colored. In some applications, it is desirable to have the container lid 24 be of a different color than the container base 22. If the container lid 24 is colored, the aperture 98 is more visible and the container 20 is easier to close. It is also easier to determine that the container 20 is securely closed when the components of the closure 56 have different colors.

The closure 26 provides a more user-friendly and ergonomic way to open the container 20. The closure 26 of the invention provides for single hand opening and closing of the container 20. Single hand container opening is important for some wet wipe applications such as for diapering of a young child. In the case of baby wipes, often times a parent must use one hand to hold the child while changing a diaper and then must use their other hand to pick up a wipe for cleaning. If the parent does not open the wipe container 20 before beginning the diaper changing process, then they must do it single handedly while changing the diaper. The baby wipe container 20 of the invention is very easily opened with one hand. In one method of opening the container 20, one or two fingers can be placed on top of the tongue projection 58 while the thumb is placed under the convex portion 96 of the container lid 24 and against the assistive region 78. With the fingers in this type of arrangement on the closure 26, the thumb can push against the assistive region 78 to raise the container lid 24 up and over the flattened grip area 74. The guide ridge 50 located on the underside of the top 40 of the container lid 24 maintains the container lid 24 in a partially open position. The partially open position of the container lid 24 prevents the container 20 from tipping over if a small number of wipes remain in the container 20.

In another embodiment, the present invention relates to a wet wipe container 20 that has a container base 22 and a container lid 24 that is connected to the container base 22. The container base 22 includes a bottom 28 and a front wall 30, rear wall 32 and a pair of opposed side walls 34, 36. The walls extend upward from the bottom 28 in a generally rectangular configuration to provide an interior 38 for containing the wet wipes. The walls may have one or more generally linear ribs 100 formed into the walls. The ribs 100 can be linear or slightly curved. The spacing between the ribs 100 can vary and the ribs 100 can be oriented either horizontally or vertically.

The ribs 100 provide several benefits including a more aesthetically appealing appearance and a container base 22 that can be more easily gripped and handled. The ribs 100 make it easier to pick up and hold the container 20. Another benefit of the ribs 100 is that the ribs 100 substantially improve the compression strength of the container 20. During shipping and storage and even during display, containers are stacked vertically on top of each other. Depending on how many containers are stacked, a given container 20 experiences some amount of vertical compression force. Conventional containers are susceptible to crushing and buckling when they have a quantity of containers stacked on top of them. Conventional container lids become crushed in a downward direction and the container bases buckle from the vertical force. The presence of ribs 100 formed into one or more walls of the container base 22 gives the container 20 overall better resistance to compressive forces. Therefore, the containers 20 of the invention experience less crushing and are more resistant to buckling. The ribs 100 can vary in length and can be of varying length within a given wall.

Accordingly, the different aspects of the present invention can advantageously provide containers for wet wipes which, when compared to conventional containers for wet wipes, provide improved single handed opening and dispensing. Such containers are particularly useful for dispensing baby wipes since the care giver typically only has one hand free during the diapering process. Thus, the containers for wet wipes of the present invention are reliably and easily opened by one hand of the user or care giver for improved convenience and personal hygiene. Additionally, the containers of the invention can maintain a partially open position of the container lid and provide better alignment between the container lid and the container base. The container lids of the invention are also more tear resistant and are less likely to fail upon repeated opening and closing of the lid. Further, the containers of the invention have improved compression strength and are more difficult to crush.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

What is claimed is:

1. A wet wipe container that includes a container base, a container lid that is hingedly connected to the container base and a closure that is configured to releasably hold the container lid on the container base in a closed position, the closure comprising:

an upright tongue projection that is continuous with and extends upward from a top surface of a front wall of the container base; the upright tongue projection has curved edges and a flattened grip area that is generally in the center of the upright tongue projection;

the top surface of the front wall also has an arcuate depression below the grip area of the upright tongue projection and an assistive region that is below the arcuate depression and concentric with the upright tongue projection; and an aperture that is located in a convex portion of a front wall of the container lid and through which the upright tongue projection extends when the container is dosed.

2. The wet wipe container of claim 1 wherein the container lid is translucent.

3. The wet wipe container of claim 1 wherein the container lid is of a color that is different than the container base.

4. The wet wipe container of claim 1 wherein the container base is translucent.

5. The wet wipe container of claim 1 wherein the container base is made from a polymer mixture comprising polystyrene.

6. The wet wipe container of claim 1 wherein the container lid has a top and a rear wall and a pair of opposed side walls that extend downwardly from the top and the container base has a bottom and a rear wall and a pair of opposed side walls that extend upwardly from the bottom to provide an interior for containing the wet wipes.

7. The wet wipe container of claim 6 wherein the container defines corners between the front walls, the rear walls, the side walls, the top and the bottom that are curvilinear.

8. The wet wipe container of claim 1 wherein the container lid and the container base are connected to each other at the rear walls by an ultrasonic bond.

9. A wet wipe container that includes a container base, a container lid that is hingedly connected to the container base and a closure that is configured to releasably hold the container lid on the container base in a closed position, the closure comprising:

an upright tongue projection that is continuous with and extends upward from a top surface of a front wall of the container base; the upright tongue projection has curved edges and a flattened grip area that is generally in the center of the upright tongue projection;

the top surface of the front wall also has an arcuate depression below the grip area of the upright tongue projection and an assistive region that is below the arcuate depression and concentric with the upright tongue projection;

an aperture that is located in a convex portion of a front wall of the container lid and through which the upright tongue projection extends when the container is closed; and the container lid has a top and a rear wall and a pair of opposed side walls that extend downwardly from the top and the container base has a bottom and a rear wall and a pair of opposed side walls that extend upwardly from the bottom to provide an interior for containing the wet wipes.

* * * * *